US009450349B1

(12) United States Patent
Chen

(10) Patent No.: US 9,450,349 B1
(45) Date of Patent: Sep. 20, 2016

(54) POWER SOCKET WITH OVER-CURRENT PROTECTION

(71) Applicant: Tsan-Chi Chen, New Taipei (TW)

(72) Inventor: Tsan-Chi Chen, New Taipei (TW)

( * ) Notice: Subject to any disclaimer, the term of this patent is extended or adjusted under 35 U.S.C. 154(b) by 0 days.

(21) Appl. No.: 14/878,193

(22) Filed: Oct. 8, 2015

(30) Foreign Application Priority Data

Jul. 14, 2015 (TW) ..... 104211314 U

(51) Int. Cl.

| | |
|---|---|
| ***H01R 13/66*** | (2006.01) |
| ***H01R 13/68*** | (2011.01) |
| ***H01R 4/48*** | (2006.01) |
| ***H01R 13/717*** | (2006.01) |

(52) U.S. Cl.
CPC ..... *H01R 13/68* (2013.01); *H01R 4/48* (2013.01); *H01R 13/717* (2013.01)

(58) Field of Classification Search
CPC H01R 13/66; H01R 13/665; H01R 13/6666; H01R 13/68; H01R 13/717
USPC ..... 439/535, 620.21
See application file for complete search history.

(56) References Cited

U.S. PATENT DOCUMENTS

| | | | | |
|---|---|---|---|---|
| 6,109,973 | A * | 8/2000 | Gronowicz, Jr. .. | H01R 13/6608 439/595 |
| 7,134,905 | B1 * | 11/2006 | Kamath ..... | H01R 9/2466 439/417 |
| 7,252,551 | B2 * | 8/2007 | Ueno ..... | H01R 4/2433 439/404 |
| 8,202,124 | B1 * | 6/2012 | Natter ..... | H01R 13/111 439/225 |
| 8,870,599 | B2 * | 10/2014 | Takemoto ..... | H01R 13/6625 439/620.21 |

* cited by examiner

*Primary Examiner* — Khiem Nugyen
(74) *Attorney, Agent, or Firm* — Bacon & Thomas, PLLC

(57) ABSTRACT

The present invention is to provide a power socket with over-current protection, which includes a shape-memory alloy plate formed with a through-opening cut therethrough and an extension plate having an end connected with an inner edge of the through-opening and other end extended away from the inner edge of the through-opening so as to form a free end; and a metal spring clip having an end connected with the free end by lap joint and other end connected with other end of the shape-memory alloy plate by lap joint in a location corresponding to the inner edge of the through-opening. When a movable contact disposed on the free end is electrically in contact with a fixed contact and the shape-memory alloy plate withstands over-current to have a temperature exceeding a predetermined temperature, the end of the shape-memory alloy plate is deformed to separate the movable contact and the fixed contact.

13 Claims, 9 Drawing Sheets

POWER SOCKET WITH OVER-CURRENT PROTECTION

FIELD OF THE INVENTION

The present disclosure relates to a power socket, in particular, to a power socket with over-current protection.

BACKGROUND OF THE INVENTION

Please refer to FIG. 1 which shows a traditional surge protector 1 available in market. The surge protector 1 includes a dielectric material 10, two conductive wires 12 and an insulating element 13. The dielectric material 10 is a plate made of polycrystalline semiconductor ceramic material which contains a vast amount of disorderly zinc oxide grains, and the boundaries between the zinc oxide grains and the other oxides form boundary layers where diode effects occur, so that the entire dielectric material is equivalent to an aggregate of a large number of diodes connected back to back. When the dielectric material is subjected to a low voltage, only a small reverse leak current flow through the dielectric material 10, but when a high voltage is applied to the dielectric material, the punch-through effect occurs, causing the large current of the high voltage to pass through the dielectric material 10. The reason why the dielectric material 10 is extensively used in making surge protectors lies in their non-linear current-voltage characteristic curves, in which electrical resistance is high under a low voltage and low under a high voltage. Two electrodes 11 are attached on two opposite sides of the dielectric material 10, respectively. Each of the two conductive wires 12 has an end fixed on the corresponding electrode 11 by welding, and other end defined as a pin 121 to electrically connect the traditional surge protector 1 to the power supply terminal of the electric device (not shown in FIG. 1). The insulating element 13 encloses the dielectric material 10, the electrodes 11 and the conductive wires 12, and only the pins 121 are exposed out of the insulating element 13.

Please refer back to FIG. 1. In the traditional surge protector 1, the fixed connection regions between the dielectric material 10 and the conductive wires 12 withstanding an extremely high voltage and current tends to cause breakage of the physical connections. Moreover, because of the extremely high voltage and current that the dielectric material 10 has to withstand per unit area, a strong transient overvoltage may pass through the dielectric materials 10 and form through holes in the resistors of the dielectric material 10 such that an even larger current runs through the resistors in an instant, causing high heat or fire by electric arc. Please refer to FIG. 2. In view of the aforesaid shortcomings of the traditional surge protector 1, the manufacturer connects a fuse 3 with a power supply pin of a power supply terminal Vi of the electric device 2 in series when the traditional surge protector 1 is connected between the power supply terminal Vi and a circuit of the electric device 2 in parallel, so that a fuse element of the fuse 3 can be melted under the large current run therethrough in an instant and the occurred high temperature to form a cut-off state in a condition that the breakages are occurred at the fixed connection regions between the dielectric material 10 and the conductive wires 12, or the through holes are formed in the resistors of the dielectric material 10, thereby avoiding the fire occurred by continuous power supply and protecting the electric device from damage. However, the fuse 3 not only increases manufacturing cost and design complexity, but also occupies the space for circuits, and it is a main reason why the relevant circuit cannot be designed more compact.

Please refer to FIG. 3. Some manufacturers extra install a thermal fuse 14 in the traditional surge protector 1 shown in the FIG. 1. An end 141 of the thermal fuse 14 is welded and fixed on the electrode 11. The thermal fuse 14, the dielectric material 10, the electrodes 11 and the conductive wires 12 are enclosed by the insulating element 13, and only the pins 121 and other end 142 of the thermal fuse 14 are exposed out of the insulating element 13, so that the thermal fuse 14 can be in cut-off state when sensing the temperature of the electrode 11 exceeding a predetermined threshold value, and then drive the power supply terminal to stop supplying power. However, the thermal fuse 14 not only increases the cost and volume of the surge protector, but also occupies more space for the circuit. In addition, an entire circuit of the electric device must be redesigned to timely stop supplying power according to the cut-off state of the thermal fuse 14, so the entire circuit becomes more complicated.

BRIEF SUMMARY OF THE INVENTION

An exemplary embodiment of the present disclosure provides a power socket with over-current protection, and the power socket includes a base member, an upper cover, a first conductive part, a second conductive part, a joint conductive part, a shape-memory alloy plate, a metal spring clip, and a button. The base member defines a receiving space recessed on a side thereof. The upper cover is used to cover the side of the base member to block the receiving space, and formed with at least one first insertion hole and a second insertion hole cut therethrough and in communication with the receiving space. A first plug pin and a second plug pin of a plug are respectively inserted into the first insertion hole and the second insertion hole. The first conductive part is fastened in the receiving space and electrically connected with a live wire, and formed with at least one first pin corresponding in position to the first insertion hole. The first plug pin can be abutted with the first pin and conducted with the live wire while being inserted through the insertion hole and into the receiving space. The second conductive part is fastened in the receiving space and electrically connected with a neutral wire, and formed with a fixed contact protruded thereon. The joint conductive part is fastened in the receiving space, disposed between the first conductive part and the second conductive part and formed with at least one second pin corresponding in position to the second insertion hole. The second plug pin can be abutted with the second pin while being inserted through the second insertion hole and into the receiving space. The shape-memory alloy plate is formed with a through-opening cut therethrough and an extension plate. The extension plate has an end connected with an end of the shape-memory alloy plate in a location corresponding to an inner edge of the through-opening, and other end extended towards other end of the shape-memory alloy plate corresponding to the inner edge of the through-opening so as to form a free end. The extension plate is formed with a movable contact disposed thereon near the free end. A part of the other end of the shape-memory alloy plate is fastened with the joint conductive part, and the movable contact is movable through the through-opening to touch the fixed contact to form electric connection between the joint conductive part and the second conductive part, so as to enable the second plug pin to conduct with the neutral wire. The metal spring clip has an end connected with the free end by lap joint and other end connected with other end of the shape-memory alloy plate by lap joint in a location corresponding to the inner edge of the through-opening. In a condition that the movable contact and the fixed contact are electrically connected with each other, while the shape-memory alloy plate withstands over-current to have a temperature exceeding a predetermined temperature, the end of the shape-memory alloy plate is deformed towards the second conductive part to make the other end of the extension plate deform away from the second conductive part, and the movable contact and the fixed contact are opened and maintained in a status of no contact after an elastic stress of the metal spring clip is overcome. The button is movably mounted in the upper cover, and has an end inserted into the receiving space and corresponding in position to the metal spring clip, and other end exposed out of the upper cover. When the metal spring clip is pushed by the end of the button and the elastic stress of the metal spring clip is overcome, the other end of the extension plate is deformed towards the second conductive part to make the movable contact and the fixed contact in contact with each other and in a closed-circuit status.

When the plug is inserted into the power socket and the over-current load occurs, the power socket can automatically enter the open-circuit status to stop supplying power to the electronic product. After the overload problem is solved, the power socket can be restored to the closed-circuit status by pressing the button to supplying power to the electronic product. Therefore, the power socket of the present disclosure can effectively avoid accidental disasters caused by the overcurrent load on the plug.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE INVENTION

Figure 1:
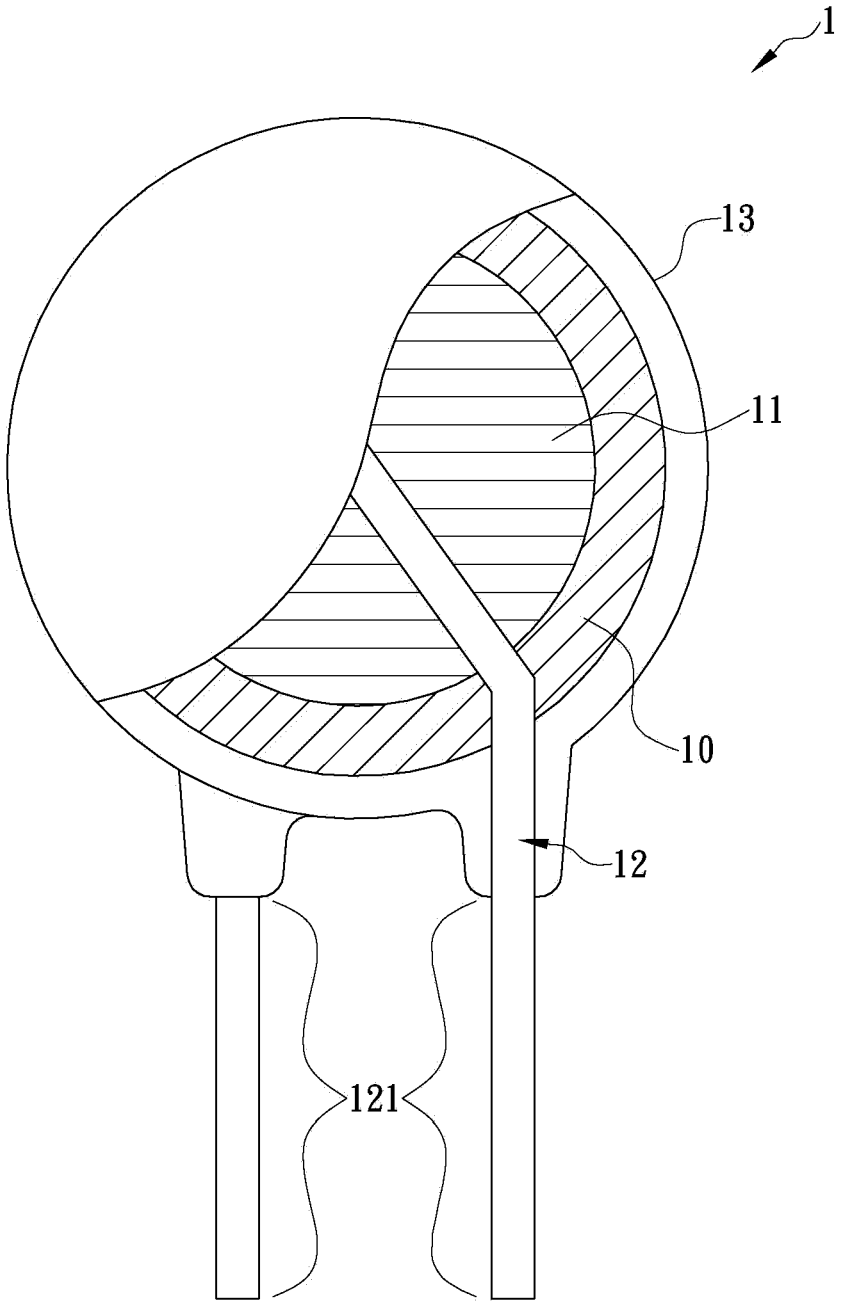
FIG. 1(Prior Art)
FIG. 1 is a cross-sectional schematic view of a part of a conventional surge protector.
Figure 2:
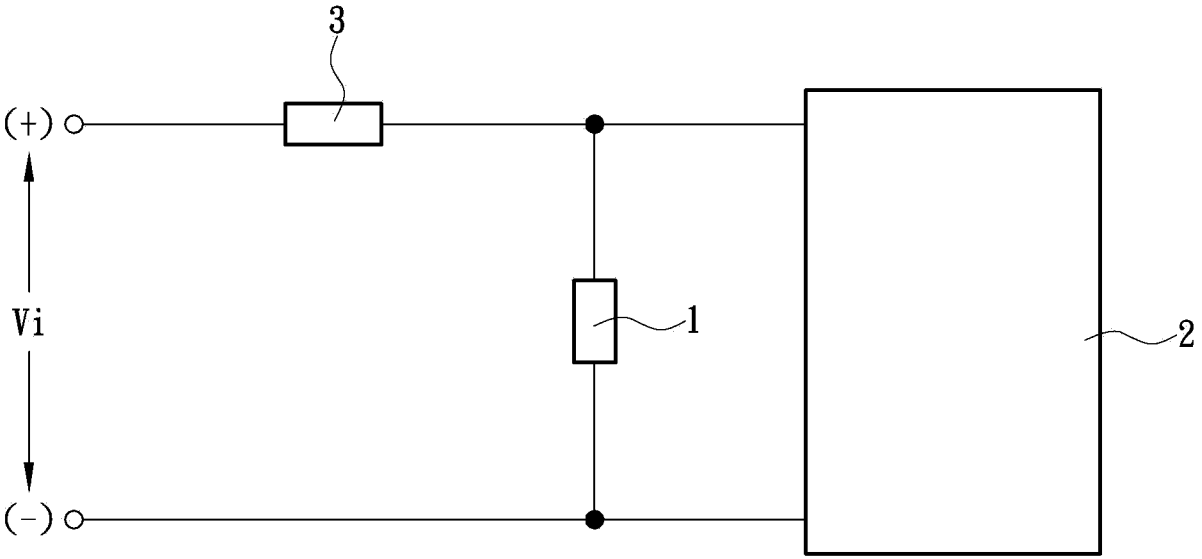
FIG. 2(Prior Art)
FIG. 2 is a schematic view of an installation circuit for the conventional surge protector.
Figure 3:
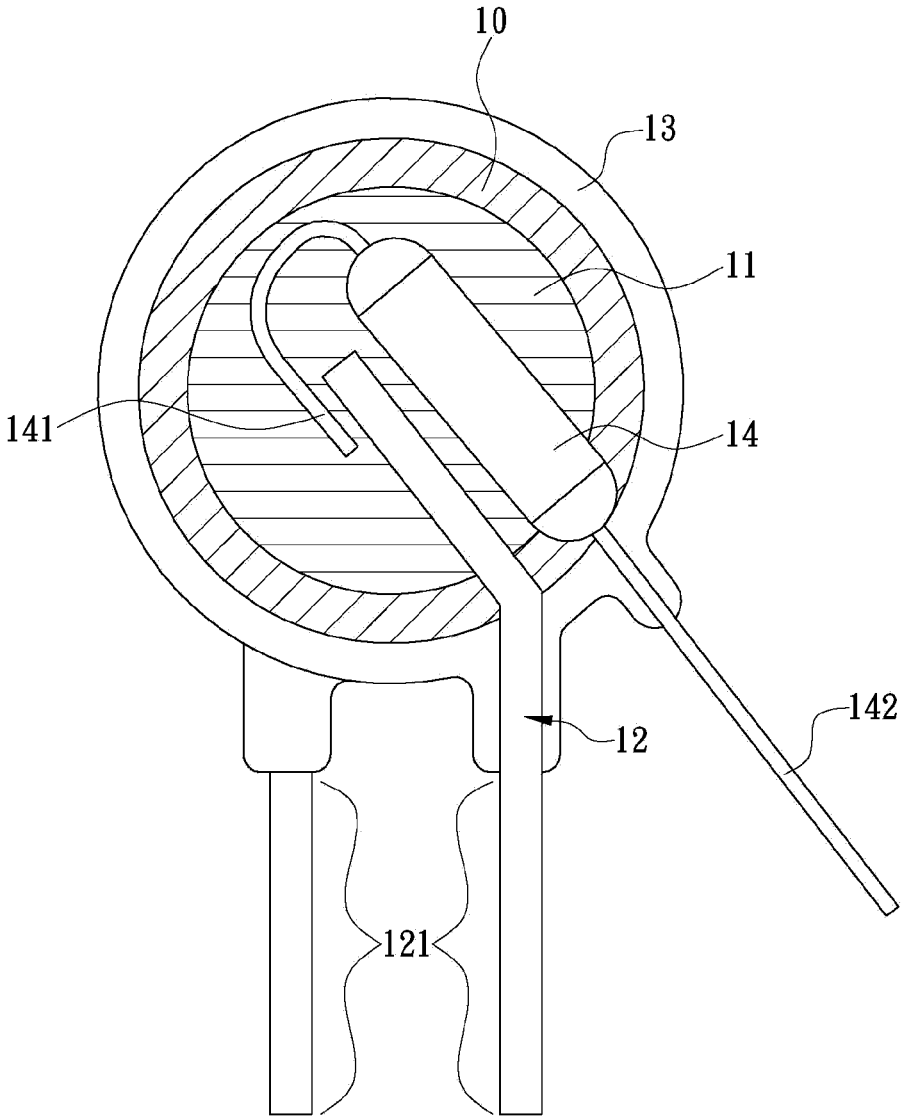
FIG. 3(Prior Art)
FIG. 3 is a cross-sectional schematic view of a part of other conventional surge protector.

Reference will now be made in detail to the exemplary embodiments of the present disclosure, examples of which are illustrated in the accompanying drawings. Wherever possible, the same reference numbers are used in the drawings and the description to refer to the same or like parts.

The present disclosure illustrates a power socket with over-current protection. Please refer to FIG. 4 which shows a first preferred embodiment of the present disclosure. The power socket 9 is used to be plugged with a plug P of an electronic product (such as an electric lamp, a computer, a water heater and so on) to supply power for normal functioning of the electronic product. The power socket 9 includes a base member 90, an upper cover 91, a first conductive part 92, a second conductive part 93, a joint conductive part 94, a shape-memory alloy plate 95, a metal spring clip 96, a button 97 and a surge protector 5. The base member 90 defines a receiving space 901 recessed on a side thereof. The upper cover 91 is covered the side of the base member 90 to block the receiving space 901 and has at least one first insertion hole 911 and a second insertion hole 912 cut therethrough. The first and second insertion holes 911 and 912 are in communication with the receiving space 901 and are used to be respectively inserted by a first plug pin P1 and a second plug pin P2 of the plug P. The first conductive part 92 is fastened in the receiving space 901 and electrically connected with a live wire (not shown in FIG. 4) of a power source. The first conductive part 92 is formed with at least one first pin 921. The first pin 921 corresponds in position to the first insertion hole 911, so that the first plug pin P1 can be abutted with the first pin 921 to conduct with the live wire while being inserted through the first insertion hole 911 and into the receiving space 901. The second conductive part 93 is fastened in the receiving space 901 and electrically connected with a neutral wire (not shown in FIG. 4) of the power source. The joint conductive part 94 is fastened in the receiving space 901 and disposed between the first conductive part 92 and the second conductive part 93, and separates the first conductive part 92 and the second conductive part 93. The joint conductive part 94 is formed with at least one second pin 941 corresponding in position to the second insertion hole 912, so that the second plug pin P2 can be abutted with the second pin 941 while being inserted through the second insertion hole 912 and into the receiving space 901. The second conductive part 93 is formed with a fixed contact T1 protruded thereon.

Figure 4:
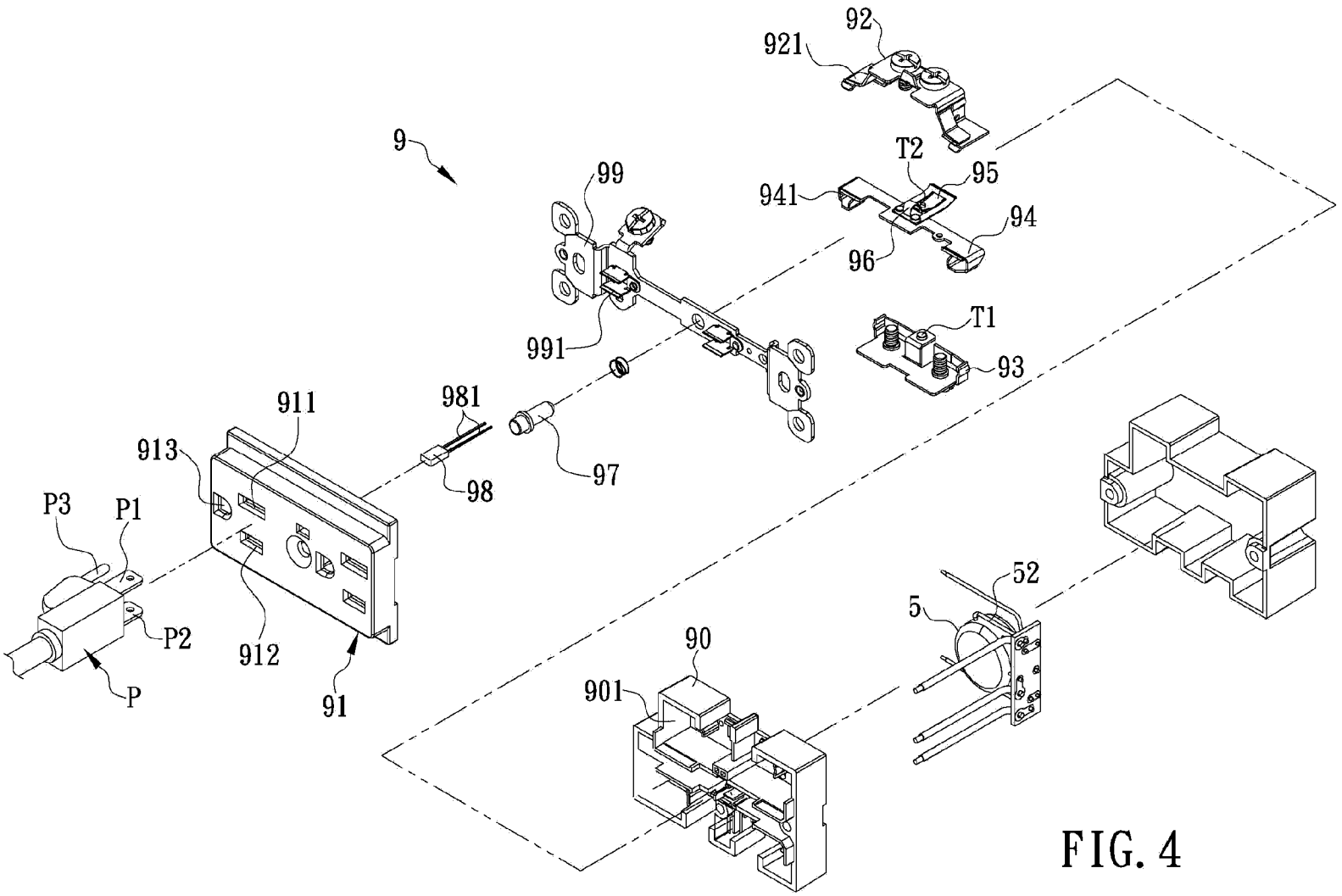
FIG. 4 is an exploded view of a first preferred embodiment of the present disclosure.
Figure 5:
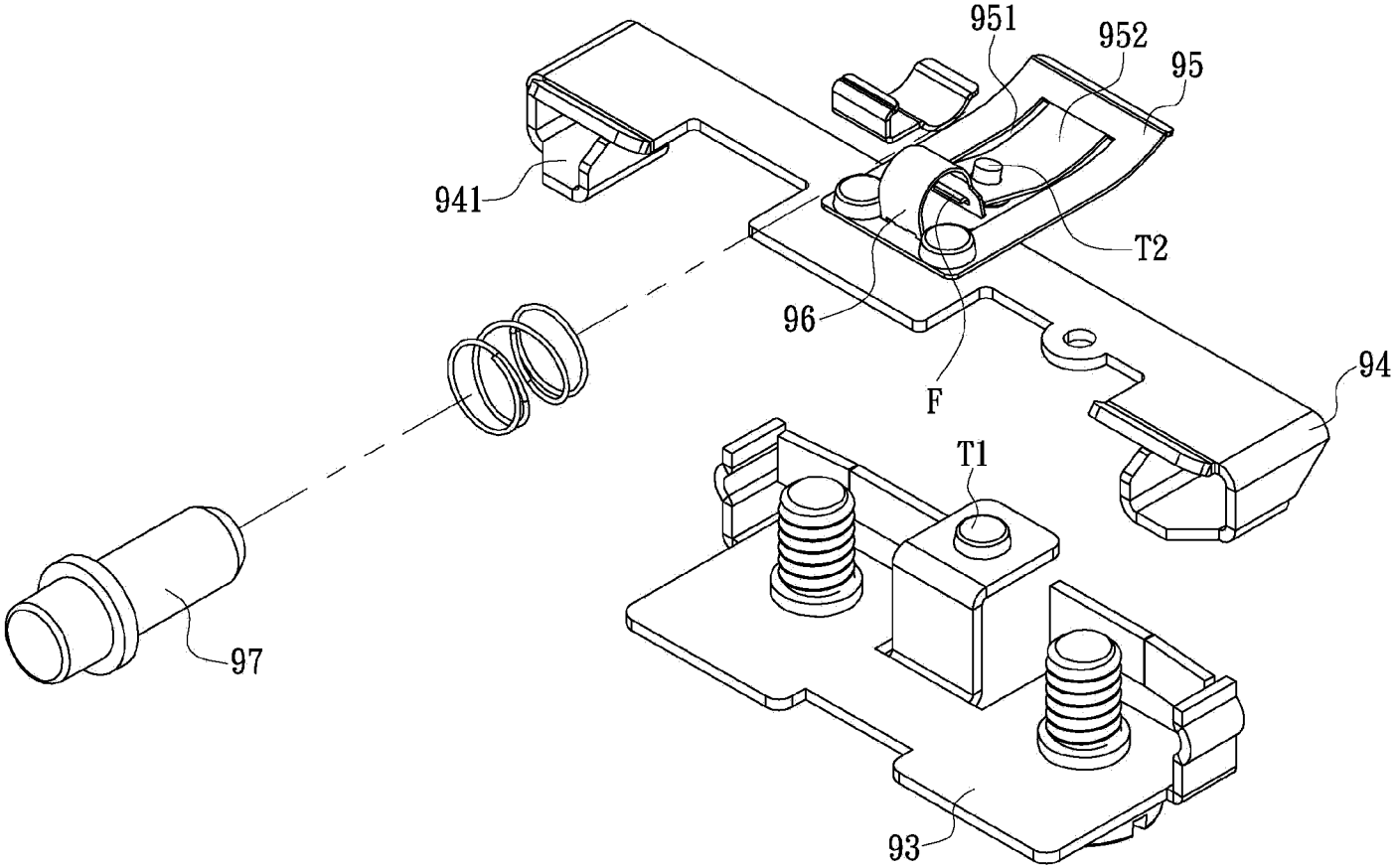
FIG. 5 is an exploded view of a device of the first preferred embodiment of the present disclosure.

Please refer to FIGS. 4 and 5. In the first preferred embodiment, the shape-memory alloy plate 95 is formed with a through-opening 951 cut therethrough and an extension plate 952 which has an end connected with an end of the shape-memory alloy plate 95 in a location corresponding to an inner edge of the through-opening 951, and other end extended towards other end of the shape-memory alloy plate 95 corresponding to the inner edge of the through-opening 951 to form a free end F. The extension plate 952 is formed with a movable contact T2 protruded thereon near the free end F. A part of the other end of the shape-memory alloy plate 95 is fastened with the joint conductive part 94. The movable contact T2 is movable through the through-opening 951 to touch the fixed contact T1 to form electric connection between the joint conductive part 94 and the second conductive part 93, thereby conducting the second plug pin P2 and the neutral wire. The metal spring clip 96 has an end connected with the free end F by lap joint, and other end connected with other end of the shape-memory alloy plate 95 by lap joint in a location corresponding to the inner edge of the through-opening 951. The button 97 is movably mounted in the upper cover 91 and has an end inserted into the receiving space 901 and corresponding in position to the metal spring clip 96, and other end exposed out of the upper cover 91. The surge protector 5 has two conductive terminals 52 which are electrically connected with the first conductive part 92 and the joint conductive part 94 respectively.

Figure 6:
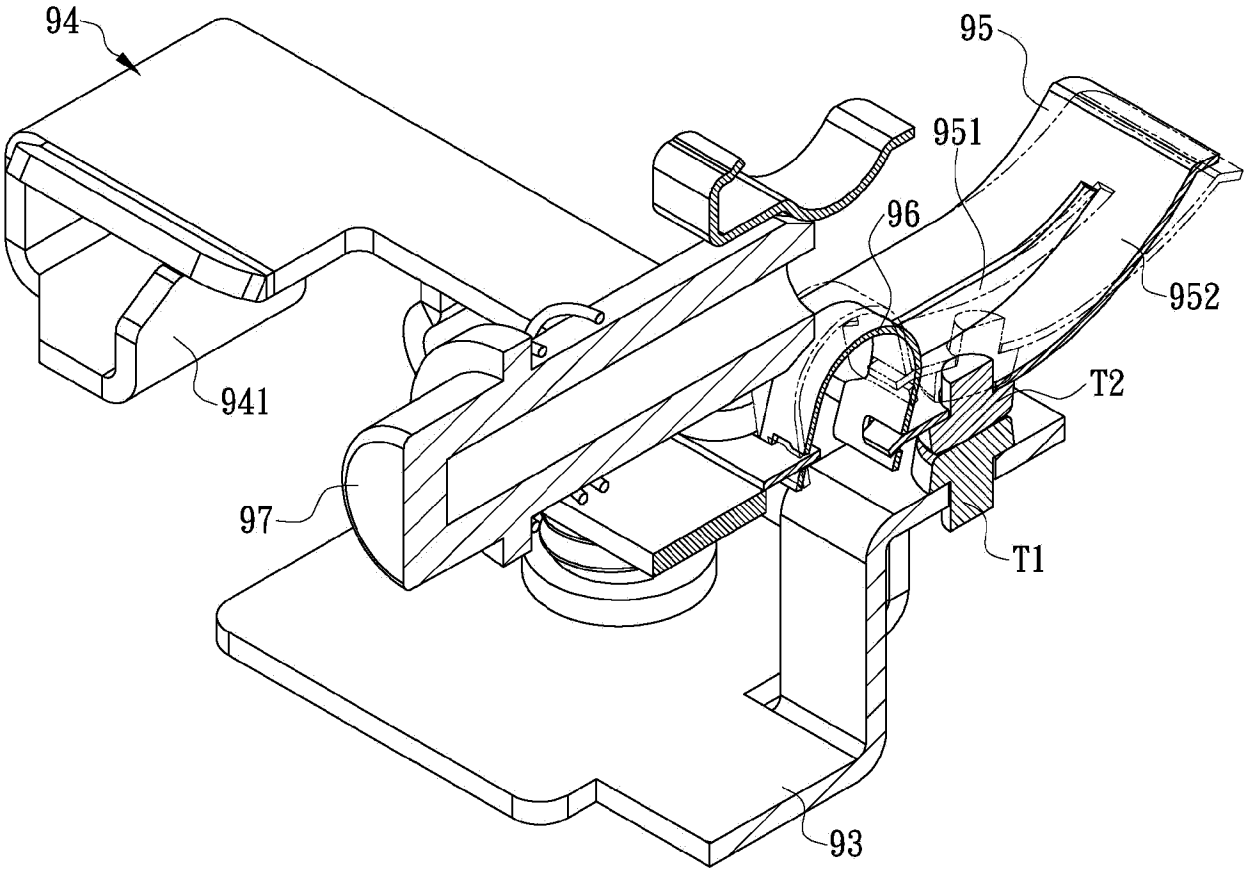
FIG. 6 is a cross-sectional schematic view of a part of the first preferred embodiment of the present disclosure, illustrating that a power socket is in closed-circuit status.

Please refer to FIG. 6. In a condition that the movable contact T2 and the fixed contact T1 are electrically conducted with each other (that is, in contact with each other) and the plug P is plugged on the power socket 9, the first plug pin P1 and the second plug pin P2 of the plug P can receive power from the live wire and the neutral wire via the first pin 921 and the second pin 941, respectively, thereby enabling the electronic product to work normally. When the electronic product causes the plug P to withstand overcurrent load for some reasons, the second conductive part 93 transmits the current to the second plug pin P2 of the plug P via the fixed contact T1, the movable contact T2, the extension plate 952, the shape-memory alloy plate 95, the joint conductive part 94 and the second pin 941 in sequential order. Therefore, when flowing through the shape-memory alloy plate 95, the overcurrent results in rapid increasing of temperature of the shape-memory alloy plate 95. When the temperature exceeds a predetermined temperature, an end of the shape-memory alloy plate 95 is deformed towards the second conductive part 93 to make the free end F of the extension plate 952 move away from the second conductive part 93. In this situation, after the free end F overcomes an elastic stress applied by the metal spring clip 96, the movable contact T2 and the fixed contact T1 are opened automatically and maintained in an open-circuit status that they are not in contact with each other, whereby the current supplied to the plug P is interrupted to ensure security of the electronic product, the plug P and the power socket 9.

Figure 7:
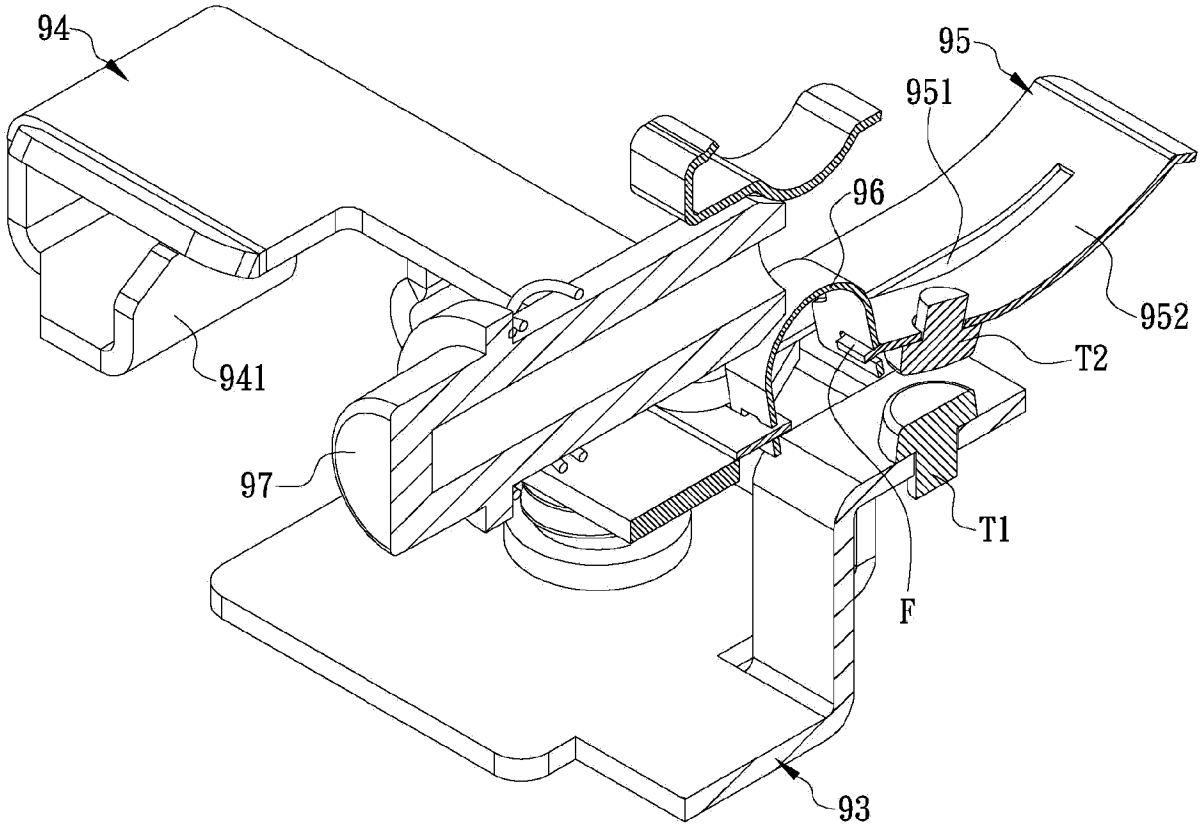
FIG. 7 is a cross-sectional schematic view of a part of the first preferred embodiment of the present disclosure, illustrating that a power socket is in open-circuit status.

Please refer to FIG. 7. In a condition that the movable contact T2 and the fixed contact T1 are not electrically conducted (that is, in an open-circuit status) and the overload problem causing the open-circuit status is solved, the user just needs to press the other end of the button 97 to move the end of the button 97 to push the metal spring clip 96. In this situation, after overcoming the elastic stress applied by the metal spring clip 96, the free end F of the extension plate 952 is moved towards the second conductive part 93 to make the movable contact T2 pass through the through-opening 951 to connect with the fixed contact T1, whereby the movable contact T2 and the fixed contact T1 are restored to the closed-circuit status that they are in contact with each other, as shown in FIG. 6. Therefore, the current received in the second conductive part 93 can be transmitted to the second plug pin P2 of the plug P via the fixed contact T1, the movable contact T2, the extension plate 952, the shape-memory alloy plate 95, the joint conductive part 94 and the second pin 941 in sequential order, thereby supplying power to the electronic product.

The power socket 9 can automatically enter the open-circuit status while the overload problem occurs, and can be restored to the closed-circuit status by pressing the button 97 after the overload problem is solved, so that the power socket 9 or the plug P is protected from accidental disasters attributable to the overcurrent load. In addition, the power socket 9 is further provided with the surge protector 5 capable of discharging surge. In the condition that the movable contact T2 and the fixed contact T1 are in electric connection, the surge protector 5 can enter the open-circuit status while the shock current flowing through the surge protector 5 causes breakage at a fixed connection region between the dielectric material and conductive terminals 52, or while the through holes are formed in the resistors of the dielectric material, so as to effectively avoid aforesaid fire danger and protect the electronic product from being damaged.

However, the present disclosure is not limited to the first preferred embodiment. Please refer back to FIG. 4. Alternatively, in other embodiment, the electric connections between the conductive parts 92 and 93 and the live and neutral wires of the power source can be exchanged. In addition, the upper cover 91 further has at least one grounding hole 913, and the power socket 9 further includes a ground conductive part 99 which is fastened in the receiving space 901 and electrically connected to an earth wire (not shown in FIG. 4). The ground conductive part 99 has at least one ground pin 991 corresponding in position to the grounding hole 913. The earthing pin P3 of the plug P can be abutted with the ground pin 991 and conducted with the earth wire while being inserted through the grounding hole 913 and into the receiving space 901.

Figure 8:
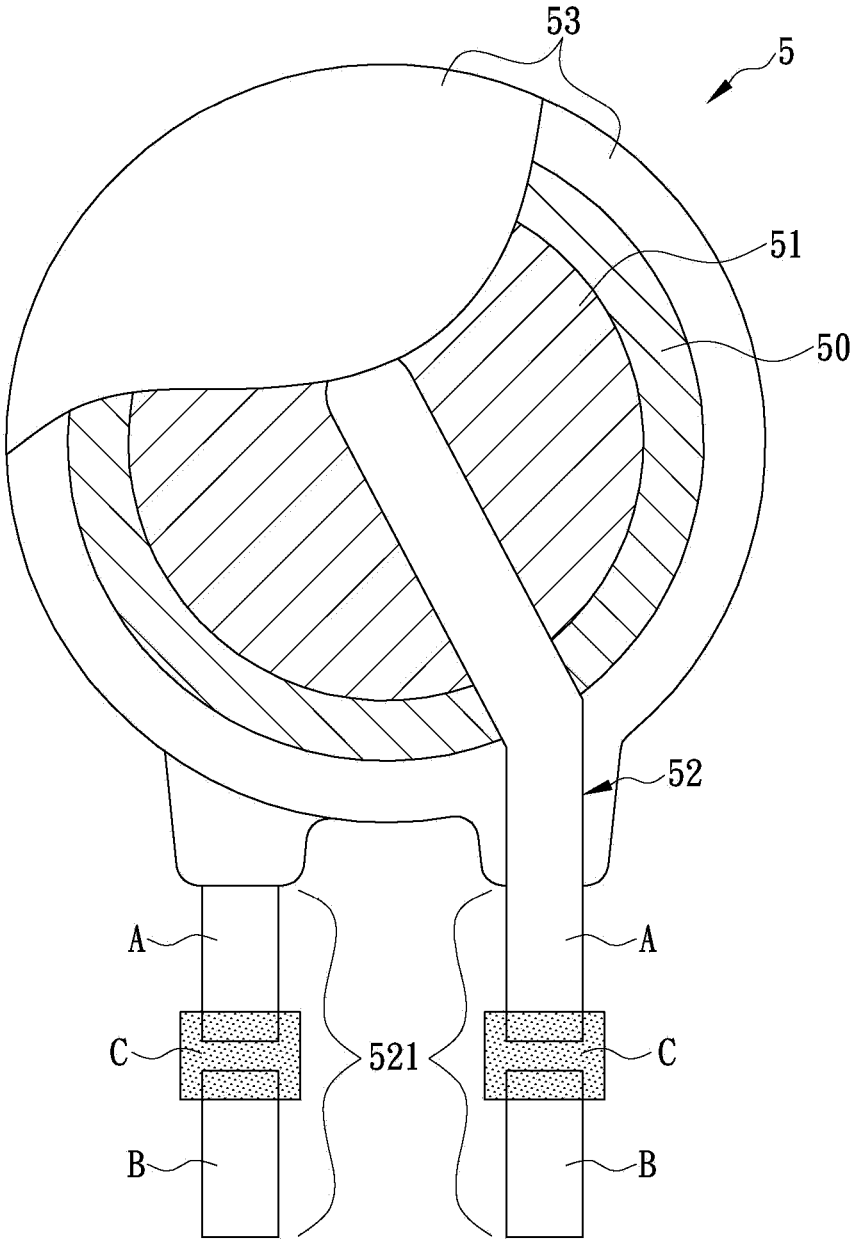
FIG. 8 is a cross-sectional schematic view of a part of a surge protector of the second preferred embodiment of the present disclosure.

Please refer to FIGS. 4 and 8. In a second preferred embodiment of the present disclosure, the surge protector 5 further includes a dielectric material 50 and an insulating element 53. The dielectric material 50 is a plate made of polycrystalline semiconductor ceramic material, and electrodes 51 are respectively attached on two opposite sides of the dielectric material 50. The conductive terminals 52 are made of a first electric conductive material, and each conductive terminal 52 has an end portion attached with a corresponding electrode 51 and other end portion defined as a first pin 521. End portions of the first pins 521 are electrically connected to the first conductive part 92 and the joint conductive part 94, respectively. The first pin 521 is divided into two sections A and B, corresponding ends of the two sections A and B are welded with a second electric conductive material C to connect in series, and the second electric conductive material C has a melting point lower than that of the first electric conductive material. When a large current flows through the conductive terminal 52 and the high temperature generated on the conductive terminal 52 exceeds the melting point of the second electric conductive material C, the second electric conductive material C is melted to make the corresponding ends of two sections A and B of the first pin 521 be cut off. The insulating element 53 encloses the dielectric material 50, the electrodes 51 and end portions of the two conductive terminals 52, and only the second electric conductive material C and the first pins 521 are exposed out of the insulating element 53. Therefore, when a shock current of the surge flows through the surge protector 5, and the high voltage causes the breakages between the end portions of the conductive terminals 52 and the corresponding electrodes 51, or punches through the dielectric material 50 to cause an extremely large current to run through the surge protector 5 in an instant and an extremely high temperature, the second electric conductive material C will be melted rapidly under the extremely large transient current or the extremely high temperature to make the first pin 521 be cut off, whereby a scheme equivalent to a fuse is generated to avoid the surge protector 5 from being burnt by the large current continuously passed therethrough and the high temperature continuously accumulated, and the electric device and its electric circuit or elements can be effectively protected from being damaged.

Figure 9:
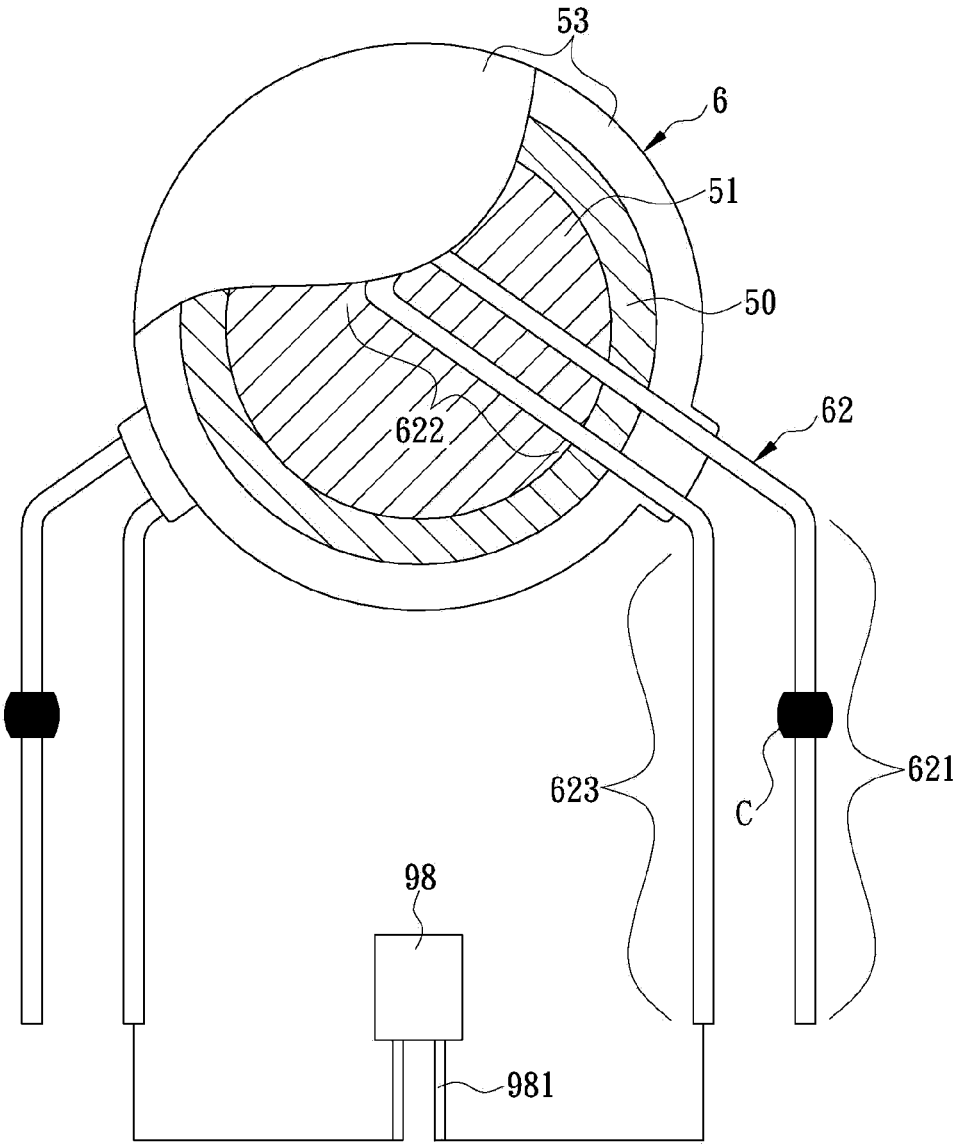
FIG. 9 is a cross-sectional schematic view of a part of a surge protector of other preferred embodiment of the present disclosure.

The conductive terminals 52 of the present disclosure are not limited to the structure shown in FIG. 8. Please refer to FIG. 9 which shows other embodiment of the present disclosure. In this embodiment, structures of the surge protector 6 and the conductive terminals 62 are different from the previous embodiment. The conductive terminal 62 is formed with a bent part 622 near an end thereof, and the bent part 622 is attached with the corresponding electrode 51 and enclosed in the insulating element 53. The conductive terminal 62 is line-shaped or plate-shaped, and the bent part 622 is connected with the corresponding electrode 51 by line contact or surface contact. Please refer back to FIG. 9. Apart from the first pin 621, the bent part 622 is further extended to form a second pin 623 which is spaced apart from the corresponding first pin 621.

Please refer back to FIGS. 4 and 9. The power socket 9 further includes a light-emitting element 98 exposed out of the upper cover 91 and having two pins 981 inserted into the receiving space 901 to electrically connect with end portions of the second pins 623 respectively, so that the light-emitting element 98 can be turned on to light while the movable contact T2 and the fixed contact T1 are in contact with each other. Therefore, in a condition that the second electric conductive material C is melted and the first pin 621 is cut off, the light-emitting element 98 stops lighting because of loss of power, it can alert the user that the surge protector 6 is broken and should be replaced promptly, so as to ensure the new surge protector to discharge the shock current occurred later.

Please refer back to FIGS. 8 and 9. In aforesaid preferred embodiments of the present disclosure, the first electric conductive material of the conductive terminals 52 and 62 has not only melting point greater that of the second electric conductive material C, but also impedance smaller than that of the second electric conductive material C. Preferably, the first electric conductive material can be copper, and the second electric conductive material C can be aluminum, silver, tin, zinc or alloy thereof. Therefore, when the extremely large transient current runs through the second electric conductive material C, the second electric conductive material C can rapidly generate the high temperature and be melted under the high temperature because of its high impedance and the low melting point, to make the first pins 521 and 621 be cut off rapidly.

The above-mentioned descriptions represent merely the exemplary embodiment of the present disclosure, without any intention to limit the scope of the present disclosure thereto. Various equivalent changes, alternations or modifications based on the claims of present disclosure, such as the metal spring clip 96 designed to be S-shaped or U-shaped, or various shapes of the button 9 or base member 90, are all consequently viewed as being embraced by the scope of the present disclosure.

What is claimed is:

1. A power socket with over-current protection, comprising:

a base member, defining a receiving space recessed on a side thereof;

an upper cover, covering the side of the base member to block the receiving space, and formed with at least one first insertion hole and a second insertion hole cut therethrough and in communication with the receiving space, and configured to be respectively inserted by a first plug pin and a second plug pin of a plug;

a first conductive part, fastened in the receiving space and electrically connected with a live wire, and formed with at least one first pin corresponding in position to the at least one first insertion hole, wherein the first plug pin is abutted with the first pin and conducted with the live wire while being inserted through the at least one insertion hole and into the receiving space;

a second conductive part, fastened in the receiving space and electrically connected with a neutral wire, and formed with a fixed contact protruded thereon;

a joint conductive part, fastened in the receiving space, disposed between the first conductive part and the second conductive part and formed with at least one second pin corresponding in position to the second insertion hole, wherein the second plug pin is abutted with the second pin while being inserted through the second insertion hole and into the receiving space;

a shape-memory alloy plate, formed with a through-opening cut therethrough and an extension plate which has an end connected with an end of the shape-memory alloy plate in a location corresponding to an inner edge of the through-opening, and other end extended towards other end of the shape-memory alloy plate corresponding to the inner edge of the through-opening to form a free end, wherein the extension plate is formed with a movable contact disposed thereon near the free end, a part of the other end of the shape-memory alloy plate is fastened with the joint conductive part, and the movable contact is movable through the through-opening to touch the fixed contact to form electric connection between the joint conductive part and the second conductive part, so as to enable the second plug pin to conduct with the neutral wire;

a metal spring clip, having an end connected with the free end by lap joint and other end connected with other end of the shape-memory alloy plate by lap joint in a location corresponding to the inner edge of the through-opening, wherein in a condition that the movable contact and the fixed contact is electrically connected with each other, while the shape-memory alloy plate withstands over-current to have a temperature exceeding a predetermined temperature, the end of the shape-memory alloy plate is deformed towards the second conductive part to make the other end of the extension plate deform away from the second conductive part, and the movable contact and the fixed contact are opened and maintained in a status of no contact after an elastic stress of the metal spring clip is overcome; and a button, movably mounted in the upper cover and having an end inserted into the receiving space and corresponding in position to the metal spring clip and other end exposed out of the upper cover, wherein when the metal spring clip is pushed by the end of the button and the elastic stress of the metal spring clip is overcome, the other end of the extension plate is deformed towards the second conductive part to make the movable contact and the fixed contact in contact with each other and in a closed-circuit status.

2. The power socket according to claim 1, further comprising a surge protector having two conductive terminals which are respectively electrically connected with the first conductive part and the joint conductive part.

3. The power socket according to claim 2, wherein the upper cover further comprises at least one grounding hole, and power socket further comprises:

a ground conductive part, fastened in the receiving space and electrically connected an earth wire and formed with at least one ground pin corresponding in position to the grounding hole, wherein an earthing pin of the plug is abutted with the ground pin to conduct with the earth wire while being inserted through the grounding hole and into the receiving space.

4. The power socket according to claim 2, wherein the surge protector comprises:

a dielectric material, being a plate made of polycrystalline semiconductor ceramic material, and two electrodes respectively attached on two opposite sides of the dielectric material;

the conductive terminals, made of a first electric conductive material, and each of the conductive terminals having an end portion attached on one of the two electrodes corresponding thereto, and other end portion defined as a first pin, end portions of the first pins of the two conductive terminals electrically connected to the first conductive part and the joint conductive part respectively, wherein each of the first pins is divided into two sections, and corresponding ends of the two sections are welded by a second electric conductive material to connect in series, and the second electric conductive material has a melting point lower than that of the first electric conductive material; and an insulating element, enclosing the dielectric material, the two electrodes and the two conductive terminals, and only the second electric conductive material and the first pins exposed out of the insulating element.

5. The power socket according to claim 3, wherein the surge protector comprises:

a dielectric material, being a plate made of polycrystalline semiconductor ceramic material, and two electrodes respectively attached on two opposite sides of the dielectric material;

the conductive terminals, made of a first electric conductive material, and each of the conductive terminals having an end portion attached on one of the two electrodes corresponding thereto, and other end portion defined as a first pin, end portions of the first pins of the two conductive terminals electrically connected to the first conductive part and the joint conductive part respectively, wherein each of the first pins is divided into two sections, and corresponding ends of the two sections are welded by a second electric conductive material to connect in series, and the second electric conductive material has a melting point lower than that of the first electric conductive material; and an insulating element, enclosing the dielectric material, the two electrodes and the two conductive terminals, and only the second electric conductive material and the first pins exposed out of the insulating element.

6. The power socket according to claim 4, wherein an end portion of each of the two conductive terminals is formed with a bent part which is attached with one of the electrodes corresponding thereto and enclosed in the insulating element, each of the bent parts is extended to form a second pin which is spaced apart from the first pin corresponding thereto and exposed out of the insulating element.

7. The power socket according to claim 5, wherein an end portion of each of the two conductive terminals is formed with a bent part which is attached with one of the electrodes corresponding thereto and enclosed in the insulating element, each of the bent parts is extended to form a second pin which is spaced apart from the first pin corresponding thereto and exposed out of the insulating element.

8. The power socket according to claim 6, further comprising a light-emitting element exposed out of the upper cover and having two pins electrically connected with the end portions of the second pins, and configured to light in a condition that the movable contact and the fixed contact are in contact with each other.

9. The power socket according to claim 7, further comprising a light-emitting element exposed out of the upper cover and having two pins electrically connected with the end portions of the second pins, and configured to light in a condition that the movable contact and the fixed contact are in contact with each other.

10. The power socket according to claim 8, wherein the first conductive material has impedance smaller than that of the second conductive material.

11. The power socket according to claim 9, wherein the first conductive material has impedance smaller than that of the second conductive material.

12. The power socket according to claim 10, wherein the first conductive material is copper, and the second conductive material is aluminum, silver, tin, zinc or alloy thereof.

13. The power socket according to claim 11, wherein the first conductive material is copper, and the second conductive material is aluminum, silver, tin, zinc or alloy thereof.

* * * * *